US006049033A

United States Patent [19]

Dallas

[11] Patent Number: 6,049,033

[45] Date of Patent: Apr. 11, 2000

[54] PAGE TURNING DEVICE

[76] Inventor: W. Gordon Dallas, 688 Township Rd. 1600, Ashland, Ohio 44805

[21] Appl. No.: 09/342,041

[22] Filed: Jun. 28, 1999

[51] Int. Cl.[7] ..... G10G 7/00

[52] U.S. Cl. ..... 84/486; 84/489; 84/500; 84/516; 84/517; 84/518; 40/531

[58] Field of Search ..... 84/486, 487, 489, 84/500, 502, 506, 507, 514, 517, 518, 520; 40/530, 531, 532

[56] References Cited

U.S. PATENT DOCUMENTS

| | | | |
|---|---|---|---|
| 868,903 | 10/1907 | Alrich | 84/518 |
| 2,755,580 | 7/1956 | Justice | 40/531 |
| 3,475,844 | 11/1969 | Uda et al. | 40/104 |
| 5,203,248 | 4/1993 | Carr et al. | 84/487 |
| 5,233,900 | 8/1993 | Fitzgerald | 84/497 |
| 5,373,772 | 12/1994 | Shemoul | 84/486 |
| 5,390,033 | 2/1995 | Bannai et al. | 358/498 |
| 5,575,097 | 11/1996 | Chou et al. | 40/531 |

OTHER PUBLICATIONS

Touch Turner Co. "Page Turning Devices" advertisement, 6 pages, (undated).

Touch Turners Operating Instructions, Touch Turner Co., 7 pages, (undated).

*Primary Examiner*—Robert E. Nappi
*Assistant Examiner*—Shih-yung Hsieh
*Attorney, Agent, or Firm*—Renner, Kenner, Greive, Bobak, Taylor & Weber

[57] ABSTRACT

A page turning device (10) is provided having a motor housing (12), an activator switch (14) and a book platform (16). A motor (18) is carried within the motor housing (12) and includes a drive shaft (20) that carries a spring arm (24) that, in turn, carries a wiping finger (26). The book platform (16) positioning the upper portion of a book placed thereon underneath a spring arm (24) and the wiping finger (26). The placement of a book on the book platform (16) may be facilitated by a book holder (38). When a book is placed on the book platform (16), activating the activator switch (14) activates the motor (18) and causes the drive shaft (20) to rotate the spring arm (24) connected thereto from a rest position so as to bring the wiping finger (26) into contact with the exposed top page of the book. The motor (18) continues through one cycle before again coming to rest, rotating the drive shaft (20) and the spring arm (24) and wiping finger (26) attached thereto, through 360 degrees. As the spring arm (24) continues its rotation, the wiping finger (26) grips the exposed page of the book and advances the exposed page to the other side of the book. Once the exposed page has been advanced and the motor (18) has completed one cycle, the spring arm (24) stops in its rotation and once again assumes the rest position.

13 Claims, 5 Drawing Sheets

PAGE TURNING DEVICE

TECHNICAL FIELD

The present invention relates generally to a page turning device, and more specifically relates to a device that, when activated, advances the right hand page of an open book such that the next pages of the book may be viewed.

BACKGROUND ART

Many people take for granted the ease by which a book may be leafed through by a simple movement of ones fingers. However, books are not so easily manipulated by those lacking the fine motor skills needed to grasp and advance each consecutive page of a book. For example, persons suffering from amyotrophic lateral sclerosis (ALS), multiple sclerosis, spinal cord injury, or other handicaps often require and desire a device to accomplish this task for them.

Such aids, which for ease of reference are herein termed "page turning devices," exist in the art. Unfortunately, many prior art devices suffer from various disadvantages such as being unable to manipulate books of various sizes and thicknesses, or requiring complex setup procedures before the device may be operated. Herein is described and disclosed a page turning device that is substantially different from those of the prior art and addresses and provides the desired characteristics of a page turning device.

DISCLOSURE OF THE INVENTION

It is therefore an object of the present invention to provide a page turning device that, when activated, will advance a single page of a book placed thereon.

It is another object of the present invention to provide a page turning device, as above, that will turn a page in a manner similar to the manner by which one turns a page by hand.

It is still another object of the present invention to provide a page turning device, as above, that is capable of turning the pages of books of various sizes and thicknesses.

It is yet another object of the present invention to provide a page turning device, as above, that is easy to utilize, requiring no substantial pre-operation or setup time.

It is a further object of the present invention to provide a page turning device, as above, that is easily operable by those whose needs are addressed by the present invention, namely, those suffering from physical maladies that make it difficult or impossible for them to manipulate the pages of a book by hand.

These and other objects of the present invention, as well as the advantages thereof over existing prior art page turning devices, which will become apparent from the description to follow, are accomplished by the improvements hereinafter described and claimed.

In general, a page turning device made in accordance with the present invention includes a motor activated by a switch. The motor includes a drive shaft carrying a spring arm which has a wiping finger connected to the end thereof. A book platform positions the upper portion of the book underneath the spring arm. Activating the switch causes the motor to rotate the drive shaft and the spring arm connected thereto from a rest position so as to bring the wiping finger in contact with an exposed page of the book. As the spring arm continues its rotation, the wiping finger grips the exposed page of the book and advances it to the other side of the book. Once the page has been advanced, the spring arm stops in its rotation at the rest position.

A preferred exemplary page turning device incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
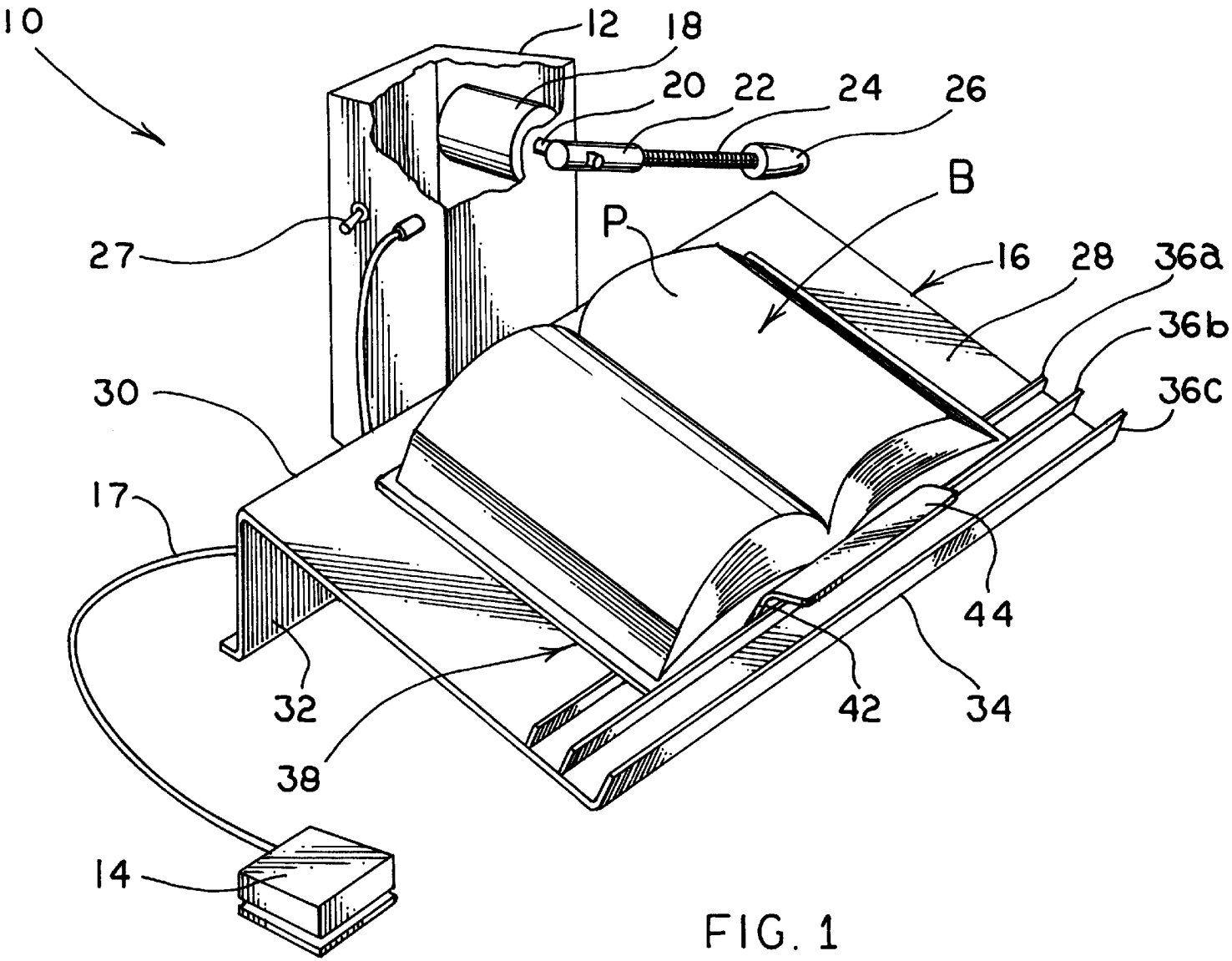
FIG. 1 is a perspective view of a page turning device made in accordance with the present invention.

A page turning device made in accordance with the present invention is designated generally by the numeral 10 and includes a motor housing 12, an activator switch 14 and a book platform 16. Preferably book platform 16 is fixedly attached to motor housing 12. However, to make page turning device 10 less burdensome to transport, it may be desirable to provide book platform 16 and motor housing 12 as separate elements or, alternatively, to provide for the selective engagement or disengagement of these elements, and such configurations of page turning device 10 are contemplated and deemed to fall within the scope of the present invention.

A motor 18 is positioned in motor housing 12 and includes a drive shaft 20 which extends outside of motor housing 12, preferably in a direction parallel to the horizontal plane. A sleeve 22 is connected to drive shaft 20 and carries a spring arm 24 to which is attached a wiping finger 26. Motor 18 is a conventional gear motor that, by means of a cam and switch (not shown), will, when activated, continue through one cycle before again coming to rest. For purposes of the present invention, "one cycle" of motor 18 entails rotating drive shaft 20, and sleeve 22, spring arm 24, and wiping finger 26 attached thereto, through 360 degrees. The details of motor 18 are not shown herein inasmuch as those skilled in the art will readily understand and appreciate the significance of the employment of a gear motor which, absent the switch, would run continuously, but with the switch, will operate for only one revolution. In addition, one of ordinary skill would readily conceive of various other motor constructions that would provide a motor capable of completing a single cycle when activated. Motor 18 may be powered by batteries or by a conventional plug-in to an electrical socket, although the use of batteries is preferred inasmuch as such use increases the transportability of device 10. Regardless of the power source used, it is preferred that motor 18 contain a basic on/off switch 27 that operates to selectively provide or deny power to motor 18.

Activator switch 14, as shown in the accompanying drawings, can be a foot pedal that is connected to motor 18 by means of a cable 17. A foot pedal provides a large target area and is unlikely to be activated by a soft touch. Thus, the employment of an activator switch 14 in the form of a foot pedal is desirable when the hand control of the user of page turning device 10 is unsure and erratic or, obviously, when the user desires to operate device 10 by foot. However, switch 14, even in its preferred form as a foot pedal, may obviously be activated by the hand or fist of the user. Moreover, it should be readily appreciated that activator switch 14 may take many forms depending upon the needs of the person that is to benefit from the use of page turning device 10. For example, if a quadriplegic would be unable to operate a foot pedal switch as shown in the accompanying drawings, activator switch 14 could take the form of a mouth switch, chin switch, blow switch, or similar device known in the art that would allow a quadriplegic to activate motor 18. Thus, the design of activator switch 14 will vary according to the needs of the user, and those skilled in the art will be able to provide a convenient, operable design for each specific user, the various designs of activator switch 14 being deemed to fall within the scope of the present invention inasmuch as this disclosure does not limit the design of activator switch 14 to that of a foot pedal.

Book platform 16 includes an inclined or ramp surface 28 having a top edge 30 which is elevated by a support wall 32. As mentioned above, book platform 16 is preferably fixedly attached to motor housing 12 at the area of top edge 30 and support wall 32, as shown in FIG. 1. However, such attachment is not necessary in that top edge 30 of book platform 16 may simply be placed adjacent to motor housing 12 during the setup of page turning device 10. The bottom edge 34 of book platform 16 is not raised off the ground as is top edge 30. Thus, book platform 16 is an inclined plane defined by ramp surface 28. As will become more apparent hereinbelow, the angle of book platform 16, in addition to providing a good page lie and good visibility to the reader, facilitates the ability of page turning device 10 to advance individual pages of a book B. Book platform 16 includes ledges 36*a*, 36*b*, and 36*c* which, as will hereinafter be described, are provided to interact with a book holder 38, shown in FIG. 2, to properly position book B on book platform 16, as now to be described.

Figure 2:
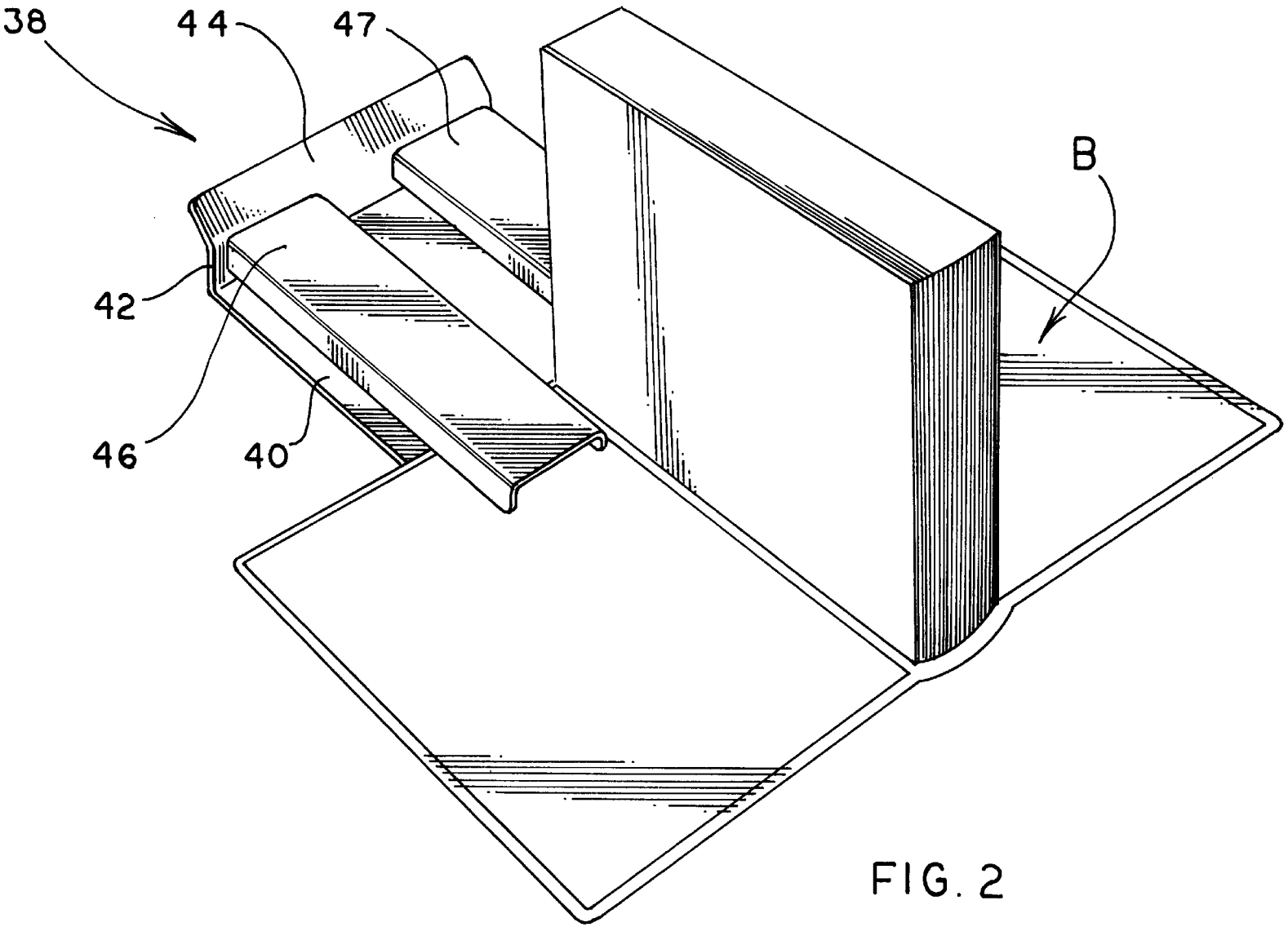
FIG. 2 is a perspective view of the book holder that forms part of the page turning device of the present invention.

Book holder 38 includes a bottom plate 40 from which extends a support edge 42 and an angled tab 44. Extending from support edge 42 in a direction parallel to bottom plate 40 are book supports 46, 47. Book supports 46, 47 are spaced from each other by a distance sufficient to receive the spine of book B, and are spaced above bottom plate 40 at a distance sufficient to receive the front and back covers of book B as shown in FIG. 2. Book B is inserted into book holder 38 by opening the covers of book B and sliding the covers into book holder 38 such that the covers fit underneath book supports 46, 47 while at the same time the spine of book B is positioned between book supports 46, 47. The pages of book B can then be opened to arch over supports 46, 47. Supports 46, 47 hold the spine and covers of book B flat against bottom plate 40 and urge the pages of book B into a natural progressive curved plane that, as will be explained below, prevents the pages of book B from buckling as each individual page is advanced by page turner 10. Book supports 46, 47, as shown in FIG. 2, have a rectangular shape to impart this natural curve to the open pages of book B. However, book supports 46, 47 are not limited to this shape and may take other shapes that would accentuate the natural arch that pages of a book form when a book is opened and laid flat.

After book B is placed in book holder 38, book holder 38 is placed on book platform 16 by resting support edge 42 of book holder 38 on selected of step 36*a*, 36*b*, or 36*c*. The size of book B will determine which step 36 will support book holder 38. For reasons that will become apparent, book B must be placed on book platform 16 such that the upper portion of book B lies in the path of rotation of spring arm 24 and wiping finger 26. Therefore, when larger books are placed in book holder 38, book holder 38 may be placed on lower step 36*c*, and, when smaller books are placed in book holder 38, book holder 38 may be placed on one of the higher steps 36*a* or 36*b*. It should be noted that, inasmuch as books come in various shapes and sizes, it may be desirable to provide more than three steps 36, and the present invention should not be limited to any specific number of steps 36, although three steps 36*a*, 36*b*, and 36*c* are deemed sufficient for books of most conventional sizes and are therefore employed in the preferred embodiment of the invention. It is also contemplated that means other than steps 36 may be used to adjust the height at which book B rests on book platform 16. For example, bottom edge 34 of book platform 16 could be provided with a telescoping step that may be slid up or down platform 16 to adjust the position of book B in relation to spring arm 24 and wiping finger 26.

Figure 3:
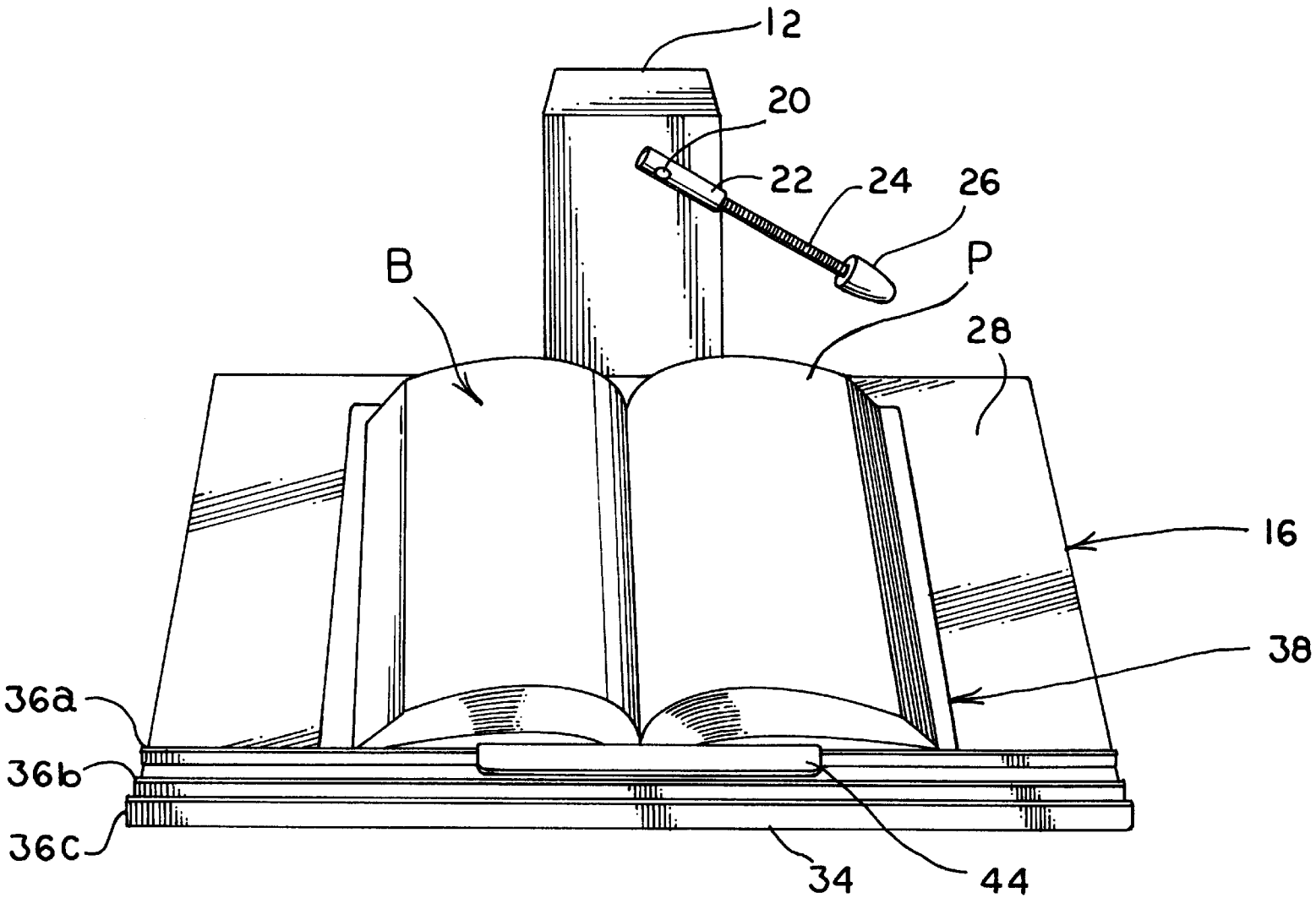
FIG. 3 is a front perspective view of the page turning device of the present invention showing the proper setup for the page turning device before the operation thereof.
Figure 4:
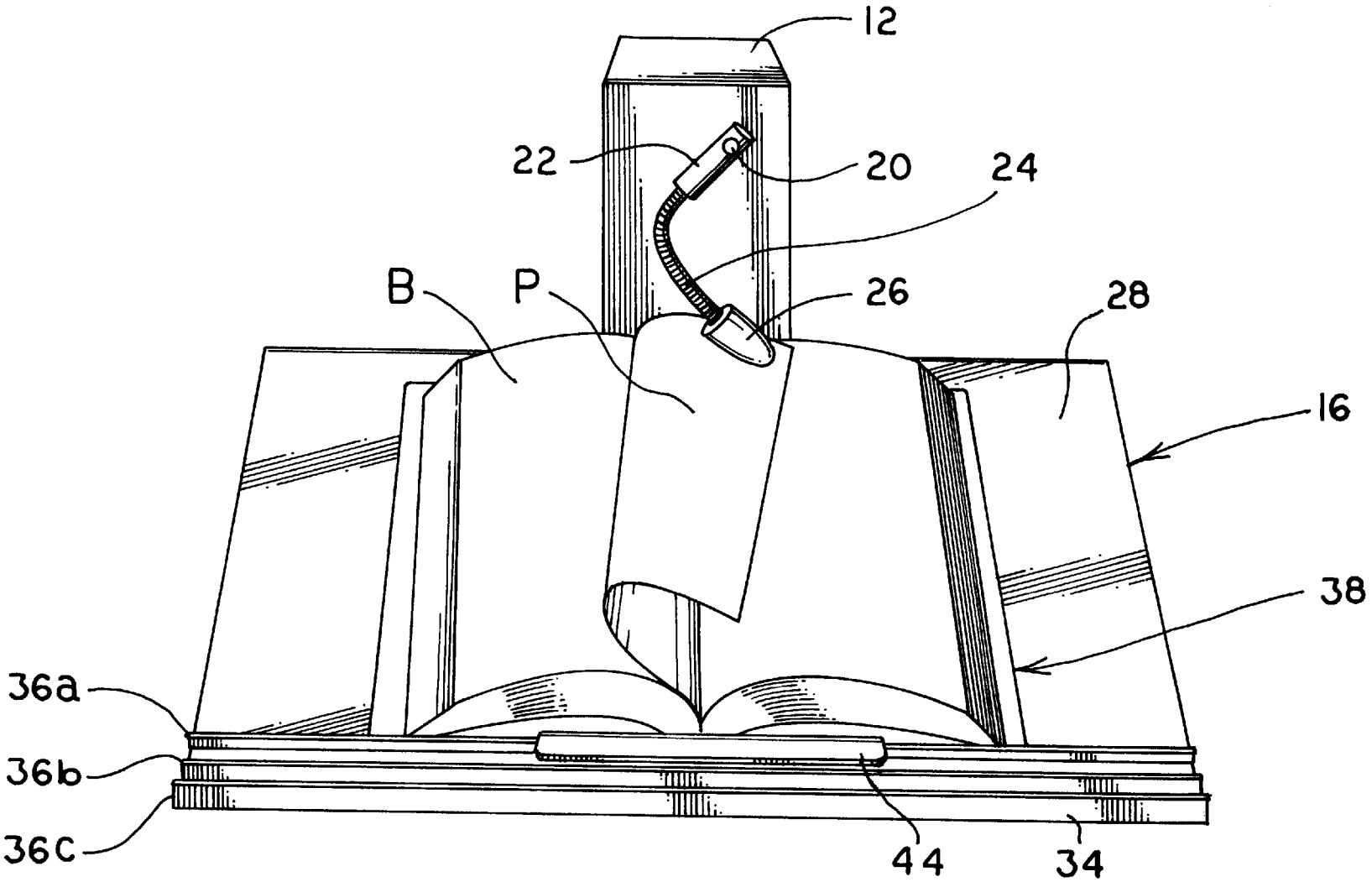
FIG. 4 is a front perspective view of the page turning device of the present invention showing the device in operation and turning the top page of a book.

Once book B is placed in book holder 38 and positioned correctly on book platform 16, as shown in FIGS. 1 and 3, page turning device 10 may be operated to advance the top exposed page P of book B. FIG. 4 shows page turning device 10 about halfway through the page turning process, when motor 18 has been activated by activator switch 14. When activator switch 14 is pressed, motor 18 is activated and begins to rotate drive shaft 20 such that sleeve 22, spring arm 24, and wiping finger 26 begin a clockwise rotation that brings wiping finger 26 into contact with top page P of book B. Wiping finger 26 then engages top page P near the right-hand, top corner, sliding page P to the left and downward in a progressive arc as drive shaft 20, sleeve 22, and spring arm 24 continue their rotation. As can be clearly seen in FIG. 4, spring arm 24 bends substantially during the page turning process. When the turning of page P is nearing completion, spring arm 24 snaps back into its straight position, urging page P to a resting position on the left-hand side of book B. The straightening of spring arm 24 also serves to separate wiping finger 26 from page P. On certain books, if this separation is not done forcefully, page P will remain in contact with wiping finger 26, and this continued contact can cause page P to fall back to the right-hand side of book B as drive shaft 20, sleeve 22, spring arm 24 and wiping finger 26 continue their rotation. As mentioned above, motor 18, when activated, completes one cycle before stopping in a rest position. Thus, activating motor 18 by activator switch 14 causes drive shaft 20 to rotate wiping finger 26 from its rest position, as shown in FIG. 3, to contact and advance page P, as shown in FIG. 4, before once again coming to rest in the position shown in FIG. 3.

The positioning of book B is important to the proper operation of page turning device 10. Wiping finger 26 should contact top page P near the right-hand top corner. As the page turning proceeds through the book, occasionally the book may be slid to the left to ensure that the wiping finger always contacts top page P close to the right-hand edge, preferably within about one-half inch. The repositioning is accomplished by sliding book holder 38 by means of angled tab 44. Usually, book B must be shifted after anywhere from 250 to 500 pages have been turned by page turning device 10, depending on the thickness of each individual page of book B.

Having set forth the basic operation of page turning device 10, it is now important to consider more specifically the various aspects of device 10 that contribute to its successful operation.

Elevating top edge 30 of book platform 16 to provide ramped surface 28 facilitates the page turning process. Elevating the upper portion of book B, and thereby angling book B with respect to drive shaft 20, ensures that wiping finger 26 will give a tangential pull downward on top page P, separating it from yet unturned pages and initiating the curvature of page P into a decreasing radius of curvature as seen in FIG. 4. Thus, page turning device 10 advances top page P in a manner similar to that by which one turns a page by hand. Preferably, ramp surface 28 is inclined at an angle from about fifteen degrees to nineteen degrees. Most preferably, ramp surface 28 is inclined at an angle of approximately seventeen degrees from horizontal.

The curving of top page P, mentioned above, is also facilitated by book supports 46, 47 of book holder 38. Book supports 46, 47 urge the pages of book B into a natural, progressive curve that imparts stiffness to the individual pages and begins the curve of top page P as it is pushed from one side of book B to the other. Without this natural curve, that is, if book supports 46, 47 were not provided to accentuate the natural curve of the pages, buckling of top page P could result and frustrate the advancement of page P.

The functions and features of spring arm 24 also play a role in the successful operation of page turning device 10. Spring arm 24 is preferably a tightly coiled, flexible spring. Due to the unique characteristics of such a spring, spring arm 24, when wiping finger 26 initially contacts top page P, has a very low initial downward force on top page P. Downward pressure by wiping finger 26 is important both at the time of contact and as top page P slides from one side of book B to the other. The pressure must be great enough to overcome the static friction of page P without being too great as to cause more than one page to turn at one time. During the sliding of top page P, it is important that the downward pressure on page P does not increase as this may cause multiple pages to turn with top page P. Thus, spring arm 24 is provided as a tightly coiled, flexible spring so that spring arm 24 will bend from about ninety degrees to about one hundred twenty degrees as top page P is turned. This bending of spring arm 24 ensures that the downward pressure on top page P does not significantly increase as page P is turned. Furthermore, spring arm 24 also twists in the direction of the bottom of top page P. This is due to the flexibility of the spring and the aforementioned approximate seventeen degree incline of ramp surface 28. This twist of spring arm 24 also helps ensure that the downward pressure on top page P remains low so that only one page is turned at one time. The bending of spring arm 24 also ensures that, when the turning of top page P is nearing completion, spring arm 24 will snap back into a straight position, thereby separating wiping finger 26 from top page P and gently sending top page P to its resting place on the other side of book B. Another aspect of spring arm 24 is that it is preferably splayed at five degrees to drive shaft 20, rather than extending perpendicularly therefrom. This slight angle aids in directing spring arm 24 to bend as page P is turned and also serves to project wiping finger 26 out away from motor housing 12 to provide better visibility of book B by the reader.

Finally, it has been determined that a motor speed of from about three to about five rpm throughout the sliding segment of the cycle of motor 18 is satisfactory to ensure a successful advancing of top page P. A motor speed of about four rpms, which results in approximately sixty-four inches per minute of travel of wiping finger 26, is most preferred.

Figure 5:
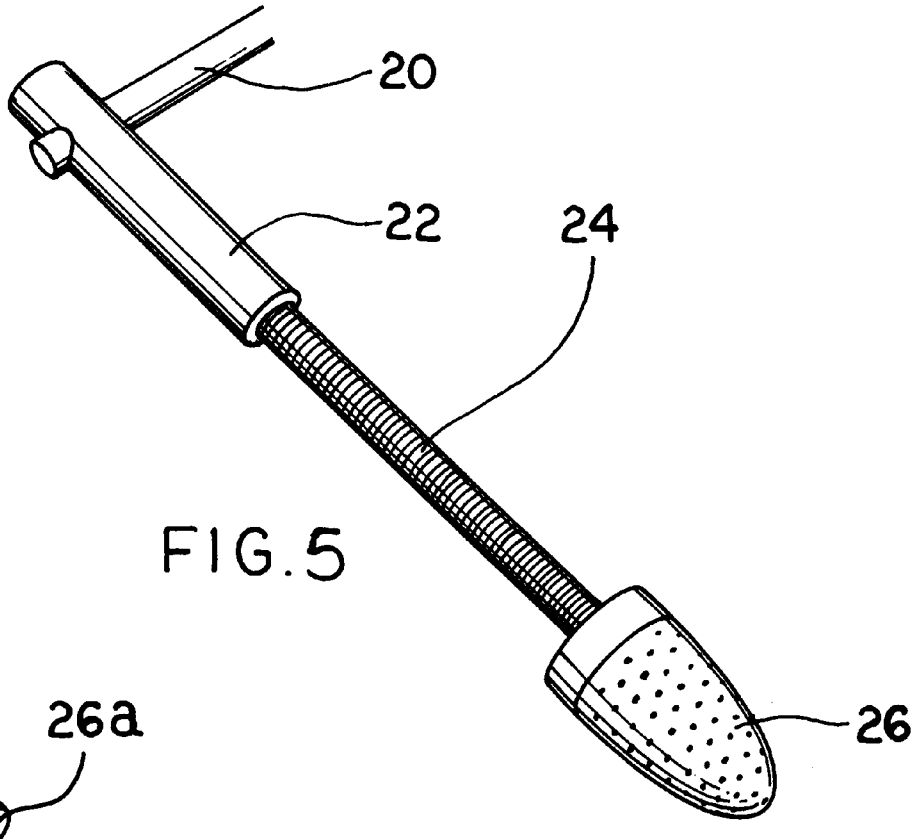
FIG. 5 is a fragmented perspective view of the wiping finger used in conjunction with the page turning device of the present invention.
Figure 6:
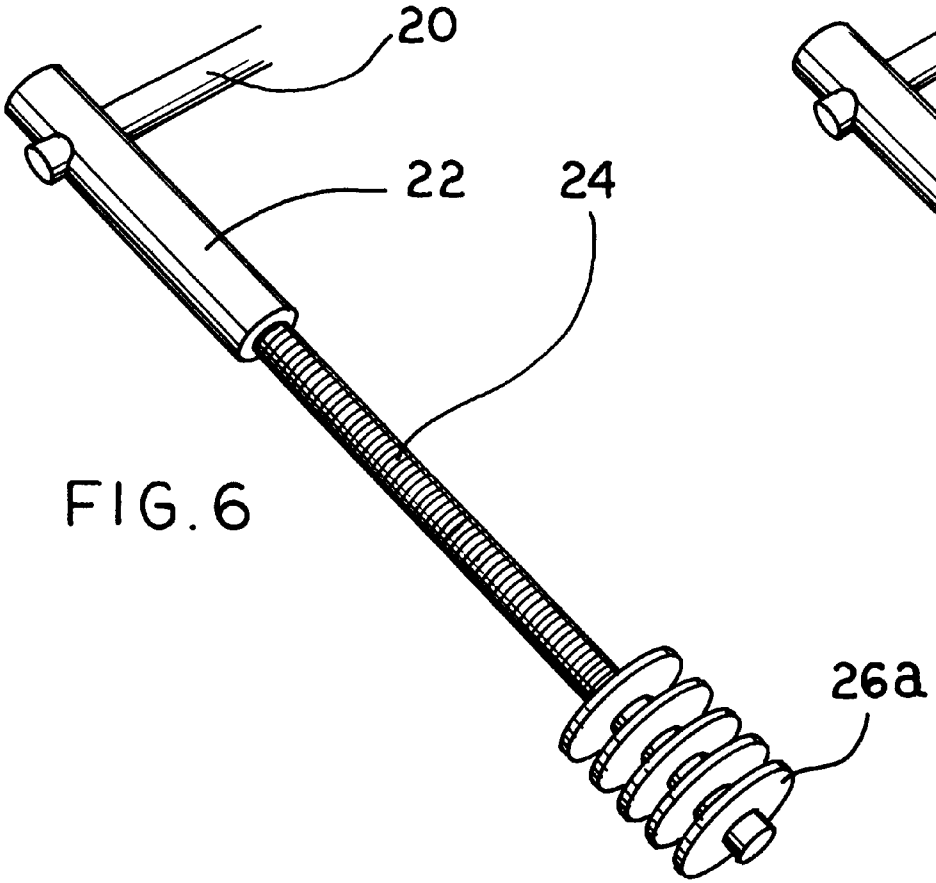
FIG. 6 is a fragmented perspective view of an alternate embodiment of a wiping finger for use in conjunction with the page turning device of the present invention.

Referring now to FIGS. 5 and 6, it can be seen that wiping finger 26 may take various forms. As shown in FIGS. 1 and 3–5, wiping finger 26 can be a basic rubber finger cot such as is often used in sorting sheets of paper. An alternate wiping finger 26*a* is shown in FIG. 6, and takes the form of a plurality of thin, flexible, preferably rubber, washers. It has been found that wiping finger 26*a* works best on certain types of books, namely those having a more glossy and smooth finish, such as the pages of a magazine. While two wiping fingers, 26 and 26*a*, are disclosed herein, the present invention should not be limited thereto or thereby, the alternate forms of wiping finger 26, 26*a* being shown to make it clear that various alternate forms of wiping finger 26, 26*a* may be included with page turning device 10, as those skilled in the art will readily be able to provide different types of wiping fingers for different needs.

While reading or leafing through a book, it may be necessary to revisit previously viewed pages. To that end, as one skilled in the art would appreciate, a switch (not shown) may be provided to interact with motor 18 and change the direction of rotation of drive shaft 20 so as to cause wiping finger 26 to contact and turn the left-hand page of book B.

In light of the foregoing, it should thus be evident that a page turning device constructed as described herein substantially improves the art and otherwise accomplishes the objects of the present invention.

What is claimed is:

1. A page turning device for selectively turning an exposed page on one side of a book comprising a motor, a shaft rotated by said motor, a spring arm carried by said shaft, a wiping finger connected to the end of said spring arm, an activator switch, and a book platform carrying the book so as to position the upper portion of the exposed page underneath said spring arm, wherein activation of said activator switch causes said motor to rotate said drive shaft thereby causing said spring arm to rotate from a rest position so as to bring said wiping finger into contact with the exposed page of the book, said wiping finger engaging the exposed page and advancing the exposed page to the other side of the book as said spring arm continues its rotation, said spring arm stopping its rotation at the rest position once the page has been advanced.

2. A page turning device according to claim 1 further comprising a book holder including a bottom plate, a first book support, and a second book support, said supports being spaced from said bottom plate and from each other such that the spine of a book may be fitted between said first and second book supports, and such that the top cover of the book may be fitted underneath said first book support, and the bottom cover of the book may be fitted underneath said second book support, said book holder being positionable on said book platform.

3. A page turning device according to claim 2 wherein said book platform includes an inclined surface such that the upper portion of the book is raised above the lower portion of the book in order to aid in the visibility of the pages.

4. A page turning device according to claim 3 wherein said book platform includes a plurality of raised steps positioned at spaced intervals near the lower end of said inclined surface such that said book holder may be selectively positioned on one of said plurality of steps to selectively position the book in relation to said spring arm.

5. A page turning device according to claim 1 wherein said drive shaft extends generally horizontally from said motor, said spring arm extends generally perpendicularly from said drive shaft, and said book platform being angled from horizontal such that when said spring arm rotates to advance the exposed page of the book, said wiping finger exerts a tangential pull downward on the exposed page to separate the exposed page from the next page and initiates the curving of the exposed page in order to facilitate the advancement thereof.

6. A page turning device according to claim 5 wherein said book platform is angled about seventeen degrees from horizontal.

7. A page turning device according to claim 6 wherein said spring arm extends outward at about five degrees from perpendicular to said drive shaft.

8. A page turning device according to claim 1 wherein said spring arm is a tightly coiled spring having a high degree of flexibility such that when said wiping finger contacts the exposed page of the book, said spring exerts a minimal initial downward force on the page so as to ensure that said wiping finger will engage and advance only the top page.

9. A page turning device according to claim 8 wherein, said spring arm bends from between ninety and one hundred twenty degrees as said spring arm rotates to advance the exposed page of the book and said wiping finger contacts the top page, thereby facilitating the curving of the top page and allowing the page to turn over in a natural arc, said spring arm also rapidly reverting to its unbent position when the advancement of the exposed page is near completion such that the exposed page is forced to separate its contact with said wiping finger and is directed to its resting position.

10. A page turning device according to claim 9 wherein said drive shaft rotates said spring arm at a speed of approximately four revolutions per minute.

11. A page turning device according to claim 1 wherein said activator switch is a foot activated pedal.

12. A page turning device according to claim 1 wherein said wiping finger is a finger cot.

13. A page turning device according to claim 1 wherein said wiping finger includes a plurality of spaced, flexible washers.

* * * * *